US011022128B2

(12) United States Patent
Inouchi et al.

(10) Patent No.: US 11,022,128 B2
(45) Date of Patent: Jun. 1, 2021

(54) AXIAL FAN

(71) Applicant: Nidec Corporation, Kyoto (JP)

(72) Inventors: Kazuhiro Inouchi, Kyoto (JP); Junya Matsuyama, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 83 days.

(21) Appl. No.: 16/402,462

(22) Filed: May 3, 2019

(65) Prior Publication Data

US 2019/0390677 A1 Dec. 26, 2019

(30) Foreign Application Priority Data

Jun. 22, 2018 (JP) ..... JP2018-118971

(51) Int. Cl.

| | |
|---|---|
| ***F04D 19/00*** | (2006.01) |
| ***F04D 19/02*** | (2006.01) |
| ***F04D 25/06*** | (2006.01) |
| ***F04D 29/52*** | (2006.01) |

(52) U.S. Cl.

CPC ..... *F04D 19/007* (2013.01); *F04D 19/024* (2013.01); *F04D 25/0606* (2013.01); *F04D 25/0613* (2013.01); *F04D 29/526* (2013.01)

(58) Field of Classification Search

CPC ... F04D 19/007; F04D 25/0606; F04D 29/526
See application file for complete search history.

(56) References Cited

U.S. PATENT DOCUMENTS

| | | | | |
|---|---|---|---|---|
| 2,339,602 A * | 1/1944 | Hagen | F04D 19/028 | 416/201 R |
| 2,384,000 A * | 9/1945 | Wattendorf | F04D 19/024 | 415/192 |
| 3,083,893 A * | 4/1963 | Dean | F04D 19/024 | 417/247 |
| 3,144,201 A * | 8/1964 | Rundle | F04D 29/324 | 415/194 |
| 6,565,334 B1 * | 5/2003 | Bradbury | F04D 29/384 | 361/695 |
| 6,612,817 B2 * | 9/2003 | Lin | F04D 19/007 | 415/199.5 |
| 6,827,549 B1 * | 12/2004 | Horng | F04D 29/582 | 415/193 |

(Continued)

FOREIGN PATENT DOCUMENTS

JP 2017-184560 A 10/2017

*Primary Examiner* — Ninh H. Nguyen
*Assistant Examiner* — Brian Christopher Delrue
(74) *Attorney, Agent, or Firm* — Keating & Bennett

(57) ABSTRACT

An axial fan includes an upper impeller disposed in an axially upper portion of a housing, and an upper circuit board disposed axially below the upper impeller. An upper impeller cup of the upper impeller includes an upper cylindrical portion and an upper lid. The axial fan includes a lower impeller disposed in an axially lower portion of the housing, and a lower circuit board disposed axially above the lower impeller. A lower impeller cup of the lower impeller includes a lower cylindrical portion and a lower lid. An axial upper end outer diameter of the upper cylindrical portion is smaller than an axial lower end outer diameter of the upper cylindrical portion. An axial lower end outer diameter of the lower cylindrical portion is smaller than an axial upper end outer diameter of the lower cylindrical portion.

12 Claims, 4 Drawing Sheets

(56) References Cited

U.S. PATENT DOCUMENTS 7,156,611 B2 * 1/2007 Oosawa ..... F04D 29/646 415/68
7,175,399 B2 * 2/2007 Matsumoto ..... H05K 7/20172 417/423.14
7,275,911 B2 * 10/2007 Lee ..... F04D 25/0613 415/211.2
7,445,423 B2 * 11/2008 Ishihara ..... F04D 19/007 415/193
7,946,805 B2 * 5/2011 Yoshida ..... H05K 7/20727 415/66
8,025,490 B2 * 9/2011 Lee ..... F04D 29/547 417/423.5
8,079,801 B2 * 12/2011 Yoshida ..... F04D 19/007 415/66
8,109,743 B2 * 2/2012 Yoshida ..... F04D 25/0693 417/423.14
8,123,461 B2 * 2/2012 Yoshida ..... F04D 29/601 415/68
8,133,006 B2 * 3/2012 Yoshida ..... F04D 25/0613 415/68
8,172,501 B2 * 5/2012 Nishizawa ..... F04D 29/522 415/68
8,183,729 B2 * 5/2012 Takeuchi ..... H02K 21/24 310/114
8,241,011 B2 * 8/2012 Huang ..... F04D 19/024 417/244
8,348,593 B2 * 1/2013 Yoshida ..... F04D 19/007 415/66
8,360,735 B2 * 1/2013 Hanaoka ..... F04D 19/007 417/2
8,668,477 B2 * 3/2014 Wu ..... F04D 19/007 417/423.5
8,727,717 B2 * 5/2014 Hsu ..... F04D 25/0613 415/199.5
8,764,375 B2 * 7/2014 Kato ..... F04D 19/007 415/68
8,807,919 B2 * 8/2014 Kato ..... F04D 19/002 415/68
9,267,505 B2 * 2/2016 Yanagisawa ..... F04D 19/024
9,599,115 B2 * 3/2017 Chou ..... F04D 29/384
9,651,051 B2 * 5/2017 Chang ..... F04D 29/601
9,964,123 B2 * 5/2018 Hayashida ..... F04D 19/007
10,267,339 B2 * 4/2019 Sun ..... F04D 29/541
10,344,764 B2 * 7/2019 Nakamura ..... F04D 25/0613
10,563,659 B2 * 2/2020 Liu ..... F04D 19/007
10,697,466 B2 * 6/2020 Hakozaki ..... F04D 29/164
2006/0045736 A1 * 3/2006 Lee ..... F04D 25/0613 415/220
2007/0059155 A1 * 3/2007 Ishihara ..... F04D 19/024 415/60
2007/0274821 A1 * 11/2007 Yoshida ..... H05K 7/20172 415/68
2007/0286720 A1 * 12/2007 Chang ..... F04D 29/542 415/198.1
2008/0031723 A1 * 2/2008 Yoshida ..... F04D 19/007 415/68
2008/0124232 A1 * 5/2008 Lee ..... F04D 19/007 417/423.5
2009/0022588 A1 * 1/2009 Chen ..... H05K 7/20172 415/218.1
2009/0035154 A1 * 2/2009 Hsu ..... F04D 19/02 417/244
2009/0040714 A1 * 2/2009 Yamada ..... H05K 7/20172 361/679.48
2009/0155104 A1 * 6/2009 Takeshita ..... F04D 25/0613 417/423.5
2009/0226299 A1 * 9/2009 Jin ..... F04D 19/007 415/66
2010/0008757 A1 * 1/2010 Yen ..... F04D 19/007 415/68
2010/0189544 A1 * 7/2010 Nakamura ..... F04D 29/668 415/68
2010/0215505 A1 * 8/2010 Takeshita ..... F04D 29/662 416/223 R
2011/0142612 A1 * 6/2011 Kato ..... F04D 19/002 415/206
2011/0142614 A1 * 6/2011 Kato ..... F04D 29/681 415/220
2012/0107120 A1 * 5/2012 Chang ..... F04D 29/662 416/145
2012/0257957 A1 * 10/2012 Yanagisawa ..... F04D 19/024 415/61
2013/0121859 A1 * 5/2013 Hirono ..... F16C 17/107 417/423.13
2014/0086761 A1 * 3/2014 Abe ..... F04D 19/007 417/338
2017/0051747 A1 * 2/2017 Nakamura ..... F04D 29/002

* cited by examiner

AXIAL FAN

CROSS REFERENCE TO RELATED APPLICATION

The present invention claims priority under 35 U.S.C. § 119 to Japanese Application No. 2018-118971 filed on Jun. 22, 2018, the entire contents of which are incorporated herein by reference.

1. FIELD OF THE INVENTION

The present disclosure relates to an axial fan.

2. BACKGROUND

A counter-rotating axial flow fan, which is a conventional axial fan, is disclosed in JP 2012-219712 A. The counter-rotating axial flow fan disclosed in JP 2012-219712 A includes a casing including an air channel, a front impeller configured to rotate in the air channel, a rear impeller configured to rotate in the air channel in a direction opposite to the front impeller. As a result, air volume and static pressure characteristics can be improved, and power consumption and noise can be reduced.

The counter-rotating axial flow fan disclosed in JP 2012-219712 A does not take into consideration the case where a large circuit board is provided as the circuit board for controlling rotation of the impeller. As a result, the hub of the impeller is increased in size and narrows the air channel, whereby the pressure-air volume characteristic of air is reduced.

SUMMARY

In view of the above points, example embodiments of the present disclosure provide axial fans that each secure installation space of a circuit board even when the circuit board is large, and favorably maintain a pressure-air volume characteristic of air.

An axial fan according to an example embodiment of the present disclosure includes a housing that extends along a central axis extending vertically, and includes an air inlet at an upper end and an air outlet at a lower end, an upper impeller that is disposed in an axially upper portion of the housing and rotates about the central axis, an upper motor that causes the upper impeller to rotate about the central axis, and an upper circuit board that is disposed axially below the upper impeller. The upper impeller includes an upper impeller cup fixed to the upper motor, and a plurality of upper blades arranged in a circumferential direction on an outer surface of the upper impeller cup. The upper impeller cup includes an upper cylindrical portion facing the upper motor in a radial direction and extending along the central axis, and an upper lid extending radially at an axial upper end of the upper cylindrical portion. The axial fan also includes a lower impeller that is disposed in an axially lower portion of the housing and rotates about the central axis, a lower motor that causes the lower impeller to rotate about the central axis, and a lower circuit board that is disposed axially above the lower impeller. The lower impeller includes a lower impeller cup fixed to the lower motor, and a plurality of lower blades arranged in the circumferential direction on an outer surface of the lower impeller cup. The lower impeller cup includes a lower cylindrical portion facing the lower motor in the radial direction and extending along the central axis, and a lower lid extending radially at an axial lower end of the lower cylindrical portion. An axial upper end outer diameter of the upper cylindrical portion is smaller than an axial lower end outer diameter of the upper cylindrical portion. An axial lower end outer diameter of the lower cylindrical portion is smaller than an axial upper end outer diameter of the lower cylindrical portion. The axial lower end outer diameter of the lower cylindrical portion is smaller than the axial lower end outer diameter of the upper cylindrical portion.

According to an example embodiment of the present disclosure, installation space of a circuit board is able to be secured even when the circuit board is large, and the pressure-air volume characteristic of air is able to be favorably maintained.

The above and other elements, features, steps, characteristics and advantages of the present disclosure will become more apparent from the following detailed description of the example embodiments with reference to the attached drawings.

DETAILED DESCRIPTION

Figure 2:
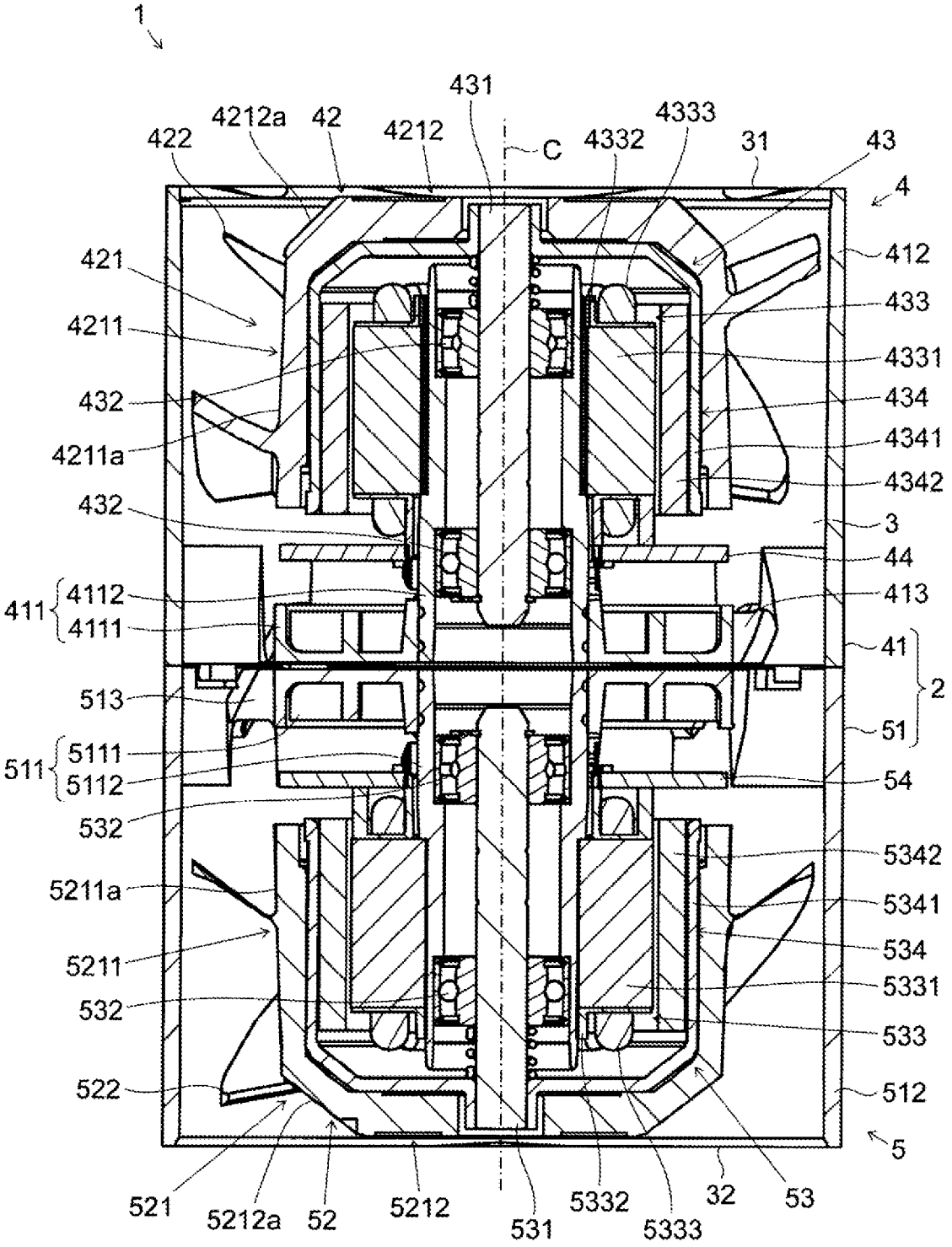
FIG. 2 is a longitudinal section of the axial fan.

Hereinafter, example embodiments of the present disclosure will be described in detail with reference to the accompanying drawings. In the specification, a direction in which a central axis of an axial fan extends is simply referred to as "axial direction", a direction perpendicular to the central axis of the axial fan as the center is simply referred to as "radial direction", and a direction extending along a circular arc centered on the central axis of the axial fan is simply referred to as "circumferential direction". Moreover, in the specification, the axial direction is the vertical direction for the sake of convenience in description, and the shape and positional relationships among parts are described on the assumption that the vertical direction in FIG. 2 is the vertical direction of the axial fan. The "upper side" of the axial fan is the "intake side" and the "lower side" of the axial fan is the "exhaust side". It should be noted, however, that the above definition of the vertical direction is not meant to restrict the orientation of, or positional relationships among parts of, the axial fan during use. Additionally, in the specification, a section parallel to the axial direction is referred to as a "longitudinal section". Additionally, the term "parallel" used in the specification does not mean parallel in a strict sense, but includes substantially parallel.

1. Overall Configuration of Axial Fan

Figure 1:
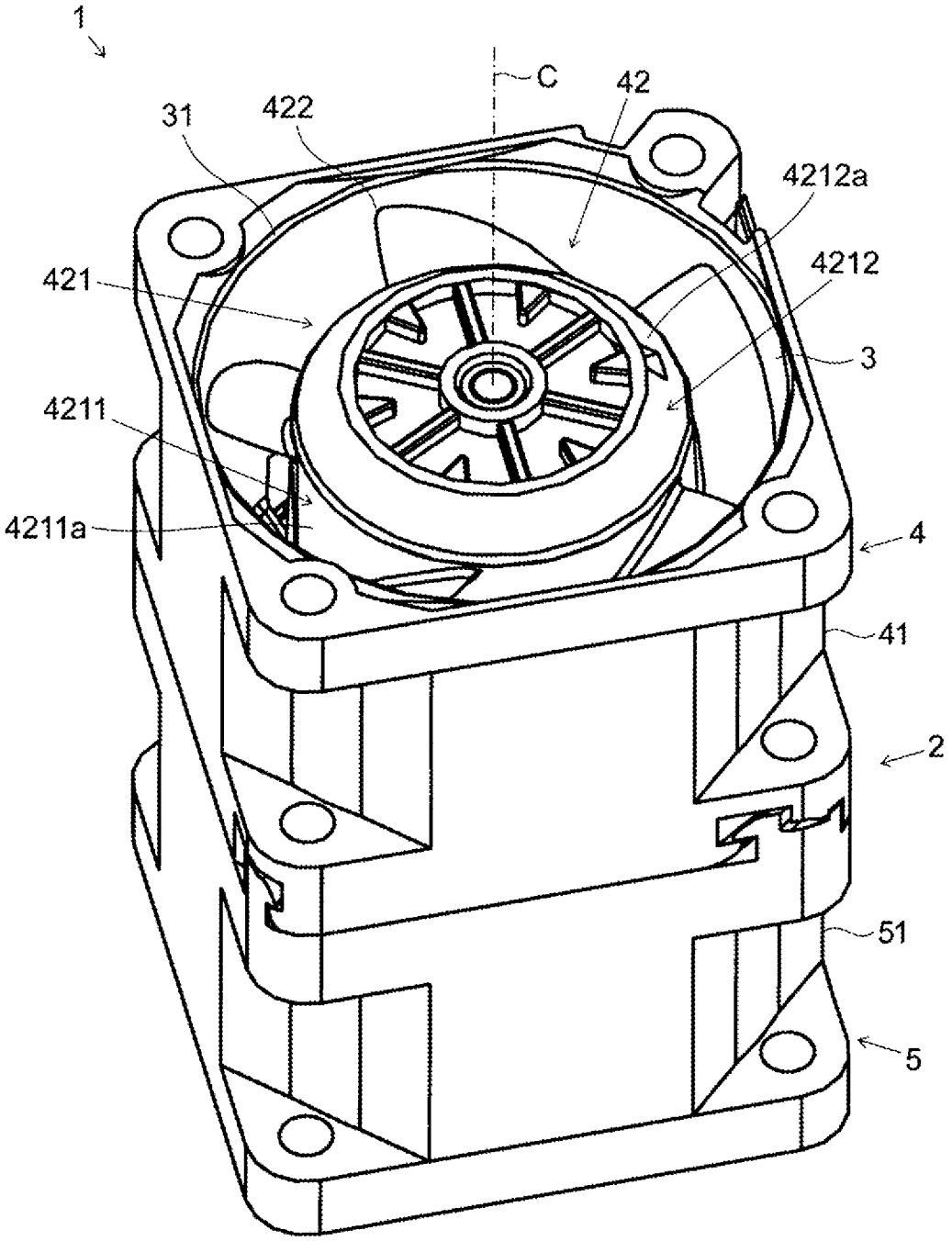
FIG. 1 is an overall perspective view of an example of an axial fan of an example embodiment of the present disclosure.

FIG. 1 is an overall perspective view of an example of an axial fan of an example embodiment of the present disclosure. FIG. 2 is a longitudinal section of the axial fan. An axial fan 1 has a housing 2. The housing 2 extends along a vertically extending central axis C and has an air flow passage 3 inside. The air flow passage 3 has an air inlet 31 at its upper end and an air outlet 32 at its lower end. That is, the housing 2 extends along the vertically extending central axis C, has the air flow passage 3 having the air inlet 31 at the upper end and the air outlet 32 at the lower end.

The axial fan 1 also has an upper fan 4 and a lower fan 5. The upper fan 4 has an upper housing 41, an upper impeller 42, an upper motor 43, and an upper circuit board 44. The lower fan 5 has a lower housing 51, a lower impeller 52, a lower motor 53, and a lower circuit board 54. That is, the axial fan 1 has the housing 2, the upper impeller 42, the upper motor 43, the upper circuit board 44, the lower impeller 52, the lower motor 53, and the lower circuit board 54. Note that the housing 2 includes the upper housing 41 and the lower housing 51.

1-1. Configuration of Upper Fan

The upper housing 41 is disposed outside the upper impeller 42, the upper motor 43, and the upper circuit board 44. The upper housing 41 has an upper motor base portion 411, an upper peripheral wall 412, and an upper rib 413.

The upper motor base portion 411 is disposed axially below the upper motor 43. The upper motor base portion 411 has a base 4111 and a bearing holder 4112. The base 4111 is disposed axially below the upper motor 43, and has a disk shape that spreads in the radial direction around the central axis C. The bearing holder 4112 protrudes axially upward from an upper surface of the base 4111. The bearing holder 4112 has a cylindrical shape centered on the central axis C. Upper bearings 432 arranged in an upper and lower pair in the axial direction are accommodated and held inside the bearing holder 4112. The upper motor 43 is fixed to a radially outer surface of the bearing holder 4112.

The upper peripheral wall 412 is disposed radially outward of the upper impeller 42. The upper peripheral wall 412 has a cylindrical shape extending to upper and lower sides in the axial direction. The air flow passage 3 is disposed radially inward of the upper peripheral wall 412. That is, the air inlet 31 which is a circular opening is disposed at the upper end of the upper peripheral wall 412 in the axial direction.

The upper rib 413 is disposed radially outward of the base 4111 of the upper motor base portion 411 and radially inward of the upper peripheral wall 412. The upper rib 413 extends radially to connect the base 4111 and the upper peripheral wall 412. A plurality of upper ribs 413 are arranged in the circumferential direction. Air flowing through the air flow passage 3 passes between the adjacent upper ribs 413.

The upper impeller 42 is disposed radially inward of the upper housing 41, and axially above and radially outward of the upper motor 43. The upper impeller 42 is rotated about the central axis C by the upper motor 43. That is, the upper impeller 42 is disposed in an axially upper portion of the housing 2 and rotates about the central axis C. The upper impeller 42 has an upper impeller cup 421 and a plurality of upper blades 422.

The upper impeller cup 421 is fixed to the upper motor 43. The upper impeller cup 421 is a substantially cylindrical member having a lid on the upper side in the axial direction. A rotor yoke 4341 of the upper motor 43 is fixed to the inside of the upper impeller cup 421. The plurality of upper blades 422 are circumferentially arranged on an outer surface of the upper impeller cup 421. A detailed configuration of the upper impeller 42 will be described later.

The upper motor 43 is disposed radially inward of the upper housing 41. The upper motor 43 is supported by the upper motor base portion 411 of the upper housing 41. The upper motor 43 rotates the upper impeller 42 about the central axis C. The upper motor 43 has an upper shaft 431, the upper bearings 432, an upper stator 433 and an upper rotor 434.

The upper shaft 431 extends along the central axis C. The upper shaft 431 is a columnar member which is made of metal such as stainless steel and extends to upper and lower sides in the axial direction. The upper shaft 431 is rotatably supported about the central axis C by the upper bearings 432.

The upper bearings 432 are arranged in at least an upper and lower pair in the axial direction. The upper bearing 432 is held inside the cylindrical bearing holder 4112 of the upper motor base portion 411. The upper bearing 432 is configured of a ball bearing, or may be configured of a sleeve bearing, for example. The upper and lower pair of upper bearings 432 in the axial direction support the upper shaft 431, so that the upper shaft 431 is rotatable about the central axis C relative to the upper housing 41.

The upper stator 433 is fixed to an outer peripheral surface of the bearing holder 4112 of the upper motor base portion 411. The upper stator 433 has a stator core 4331, an insulator 4332, and a coil 4333.

The stator core 4331 is configured by laminating electromagnetic steel plates such as silicon steel plates on top of one another, for example. The insulator 4332 is made of an insulating resin. The insulator 4332 surrounds an outer surface of the stator core 4331. The coil 4333 is configured of a conducting wire wound around the stator core 4331 through the insulator 4332.

The upper rotor 434 is disposed axially above and radially outward of the upper stator 433. The upper rotor 434 rotates about the central axis C relative to the upper stator 433. The upper rotor 434 has the rotor yoke 4341 and a magnet 4342.

The rotor yoke 4341 is a substantially cylindrical member that is made of a magnetic material and has a lid on the upper side in the axial direction. The rotor yoke 4341 is fixed to the upper shaft 431. The magnet 4342 has a cylindrical shape, and is fixed to an inner peripheral surface of the rotor yoke 4341. The magnet 4342 is disposed radially outward of the upper stator 433.

The upper circuit board 44 is disposed axially below the upper impeller 42. More specifically, the upper circuit board 44 is disposed axially below the upper impeller 42 and the upper motor 43 and axially above the base 4111 of the upper motor base portion 411. The upper circuit board 44 has a disk shape that spreads in the radial direction around the central axis C, for example. A lead of the coil 4333 is electrically connected to the upper circuit board 44. An electric circuit for supplying a drive current to the coil 4333 is mounted on the upper circuit board 44.

In the upper fan 4 configured as described above, when a drive current is supplied to the coil 4333 of the upper motor 43 through the upper circuit board 44, a radial magnetic flux is generated in the stator core 4331. A magnetic field generated by the magnetic flux of the stator core 4331 and a magnetic field generated by the magnet 4342 act to generate torque in the circumferential direction of the upper rotor 434. The torque causes the upper rotor 434 and the upper impeller 42 to rotate about the central axis C. As the upper impeller 42 rotates, the plurality of upper blades 422 generate an air flow. That is, in the upper fan 4, air can be blown by generating an air flow where the upper side is the intake side and the lower side is the exhaust side.

1-2. Configuration of Lower Fan

The lower housing 51 is disposed outside the lower impeller 52, the lower motor 53, and the lower circuit board 54. The lower housing 51 has a lower motor base portion 511, a lower peripheral wall 512, and a lower rib 513.

The lower motor base portion 511 is disposed axially above the lower motor 53. The lower motor base portion 511 has a base 5111 and a bearing holder 5112. The base 5111 is disposed axially above the lower motor 53, and has a disk shape that spreads in the radial direction around the central axis C. The bearing holder 5112 protrudes axially downward from a lower surface of the base 5111. The bearing holder 5112 has a cylindrical shape centered on the central axis C. Lower bearings 532 arranged in an upper and lower pair in the axial direction are accommodated and held inside the bearing holder 5112. The lower motor 53 is fixed to a radially outer surface of the bearing holder 5112.

The lower peripheral wall 512 is disposed radially outward of the lower impeller 52. The lower peripheral wall 512 has a cylindrical shape extending to upper and lower sides in the axial direction. The air flow passage 3 is disposed radially inward of the lower peripheral wall 512. That is, the air outlet 32, which is a circular opening is disposed at the lower end of the lower peripheral wall 512 in the axial direction.

The lower rib 513 is disposed radially outward of the base 5111 of the lower motor base portion 511 and radially inward of the lower peripheral wall 512. The lower rib 513 extends radially to connect the base 5111 and the lower peripheral wall 512. A plurality of lower ribs 513 are arranged in the circumferential direction. Air flowing through the air flow passage 3 passes between the adjacent lower ribs 513.

The lower impeller 52 is disposed radially inward of the lower housing 51 and axially below and radially outward of the lower motor 53. The lower impeller 52 is rotated about the central axis C by the lower motor 53. That is, the lower impeller 52 is disposed in an axially lower part of the housing 2 and rotates about the central axis C. The lower impeller 52 has a lower impeller cup 521 and a plurality of lower blades 522.

The lower impeller cup 521 is fixed to the lower motor 53. The lower impeller cup 521 is a substantially cylindrical member having a lid on the lower side in the axial direction. A rotor yoke 5341 of the lower motor 53 is fixed to the inside of the lower impeller cup 521. The plurality of lower blades 522 are circumferentially arranged on an outer surface of the lower impeller cup 521. A detailed configuration of the lower impeller 52 will be described later.

The lower motor 53 is disposed radially inward of the lower housing 51. The lower motor 53 is supported by the lower motor base portion 511 of the lower housing 51. The lower motor 53 causes the lower impeller 52 to rotate about the central axis C. The lower motor 53 has a lower shaft 531, the lower bearings 532, a lower stator 533, and a lower rotor 534.

The lower shaft 531 extends along the central axis C. The lower shaft 531 is a columnar member which is made of metal such as stainless steel and extends to upper and lower sides in the axial direction. The lower shaft 531 is rotatably supported about the central axis C by the lower bearings 532.

The lower bearings 532 are arranged in at least an upper and lower pair in the axial direction. The lower bearing 532 is held inside the cylindrical bearing holder 5112 of the lower motor base portion 511. The lower bearing 532 is configured of a ball bearing, or may be configured of a sleeve bearing, for example. The upper and lower pair of lower bearings 532 in the axial direction support the lower shaft 531, so that the lower shaft 531 is rotatable about the central axis C relative to the lower housing 51.

The lower stator 533 is fixed to an outer peripheral surface of the bearing holder 5112 of the lower motor base portion 511. The lower stator 533 includes a stator core 5331, an insulator 5332, and a coil 5333.

The stator core 5331 is configured by laminating electromagnetic steel plates such as silicon steel plates on top of one another, for example. The insulator 5332 is made of an insulating resin. The insulator 5332 surrounds an outer surface of the stator core 5331. The coil 5333 is configured of a conducting wire wound around the stator core 5331 through the insulator 5332.

The lower rotor 534 is disposed axially below and radially outward of the lower stator 533. The lower rotor 534 rotates about the central axis C relative to the lower stator 533. The lower rotor 534 has the rotor yoke 5341 and a magnet 5342.

The rotor yoke 5341 is a substantially cylindrical member that is made of a magnetic material and has a lid on the lower side in the axial direction. The rotor yoke 5341 is fixed to the lower shaft 531. The magnet 5342 has a cylindrical shape, and is fixed to an inner peripheral surface of the rotor yoke 5341. The magnet 5342 is disposed radially outward of the lower stator 533.

The lower circuit board 54 is disposed axially above the lower impeller 52. More specifically, the lower circuit board 54 is disposed axially above the lower impeller 52 and the lower motor 53 and axially below the base 5111 of the lower motor base portion 511. The lower circuit board 54 has a disk shape that spreads in the radial direction around the central axis C, for example. A lead of the coil 5333 is electrically connected to the lower circuit board 54. An electric circuit for supplying a drive current to the coil 5333 is mounted on the lower circuit board 54.

In the lower fan 5 configured as described above, when a drive current is supplied to the coil 5333 of the lower motor 53 through the lower circuit board 54, a radial magnetic flux is generated in the stator core 5331. A magnetic field generated by the magnetic flux of the stator core 5331 and a magnetic field generated by the magnet 5342 act to generate torque in the circumferential direction of the lower rotor 534. The torque causes the lower rotor 534 and the lower impeller 52 to rotate about the central axis C. As the lower impeller 52 rotates, the plurality of lower blades 522 generate an air flow. That is, in the lower fan 5, air can be blown by generating an air flow where the upper side is the intake side and the lower side is the exhaust side.

2. Detailed Configuration of Upper Impeller and Lower Impeller

Figure 3:
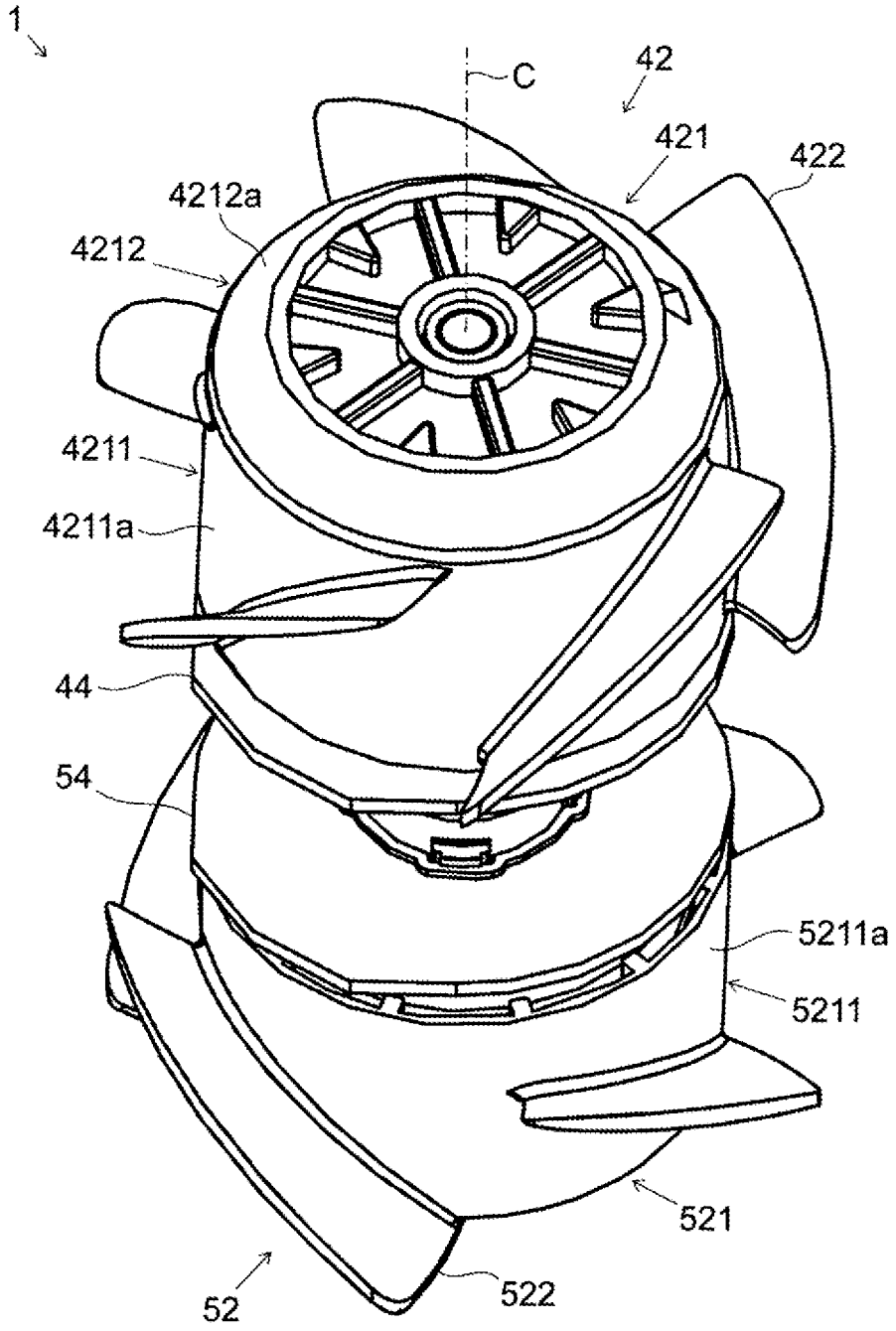
FIG. 3 is an overall perspective view of the axial fan from which a housing is omitted.
Figure 4:
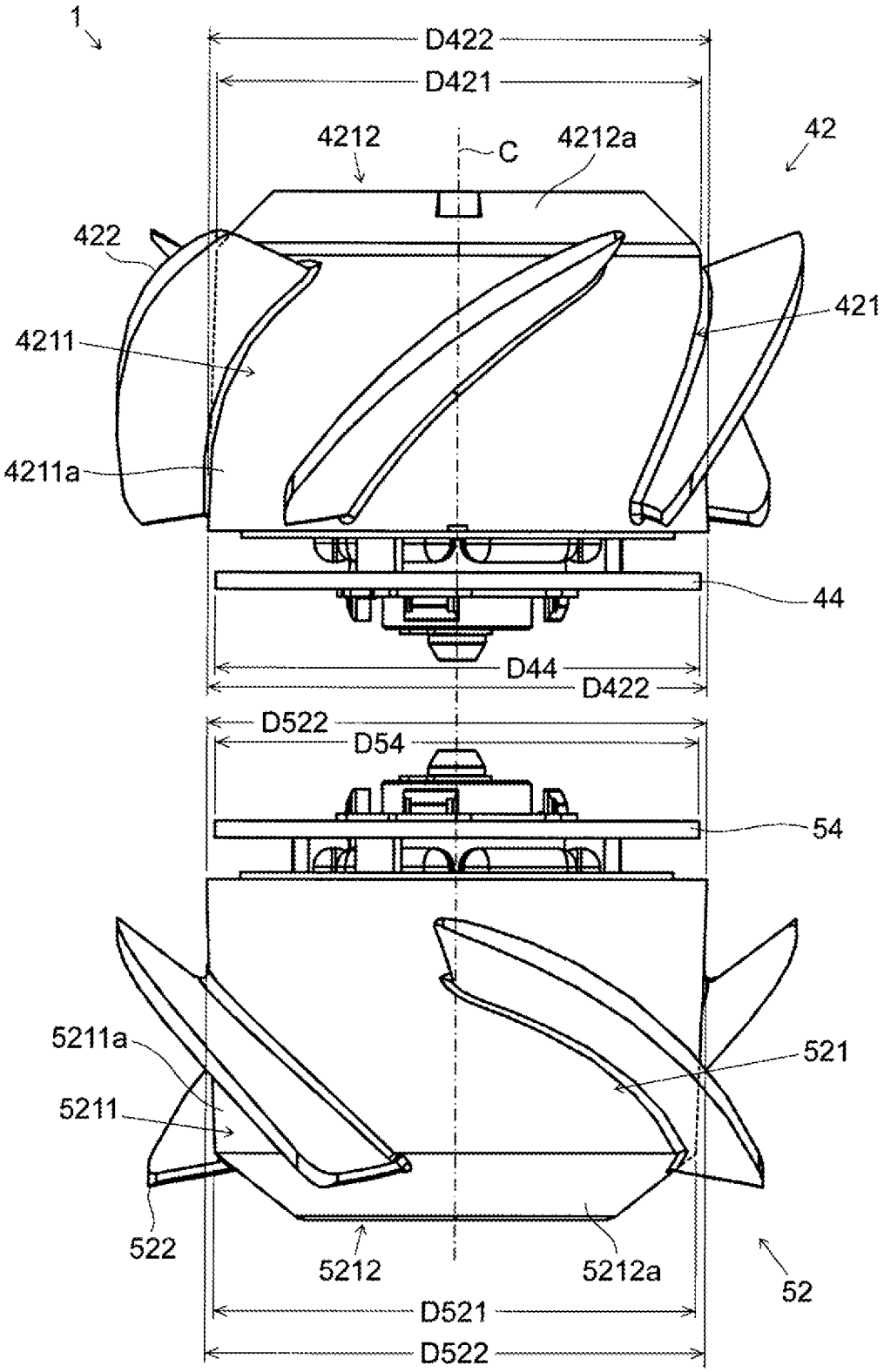
FIG. 4 is a side view of the axial fan from which the housing is omitted.

Next, detailed configurations of the upper impeller 42 and the lower impeller 52 will be described with reference to FIGS. and 4 in addition to FIGS. 1 and 2. FIG. 3 is an overall perspective view of the axial fan 1 from which the housing 2 is omitted. FIG. 4 is a side view of the axial fan 1 from which the housing 2 is omitted. For convenience of explanation, in FIG. 4, an axial lower end outer diameter D422 of an upper cylindrical portion 4211 and an axial upper end outer diameter D522 of a lower cylindrical portion 5211 are shown in both upper and lower parts of each of the upper impeller 42 and the lower impeller 52.

The upper impeller cup 421 has the upper cylindrical portion 4211 and an upper lid 4212. The upper cylindrical portion 4211 and the upper lid 4212 are a single member.

The upper cylindrical portion 4211 is disposed radially outward of the upper motor 43, and includes the upper motor 43 in the radial direction. The upper cylindrical portion 4211 extends vertically along the central axis C. That is, the upper cylindrical portion 4211 faces the upper motor 43 in the radial direction, and extends along the central axis C.

The upper lid 4212 is disposed in an axial upper end portion of the upper cylindrical portion 4211. The upper lid 4212 has a disk shape that spreads in the radial direction around the central axis C. An outer edge portion of the upper lid 4212 is connected to the axial upper end portion of the upper cylindrical portion 4211. That is, the upper lid 4212 spreads in the radial direction at the axial upper end of the upper cylindrical portion 4211.

The lower impeller cup 521 has the lower cylindrical portion 5211 and a lower lid 5212. The lower cylindrical portion 5211 and the lower lid 5212 are a single member.

The lower cylindrical portion 5211 is disposed radially outward of the lower motor 53, and includes the lower motor 53 in the radial direction. The lower cylindrical portion 5211 extends vertically along the central axis C. That is, the lower cylindrical portion 5211 faces the lower motor 53 in the radial direction, and extends along the central axis C.

The lower lid 5212 is disposed in an axial lower end portion of the lower cylindrical portion 5211. The lower lid 5212 has a disk shape that spreads in the radial direction around the central axis C. An outer edge portion of the lower lid 5212 is connected to the axial lower end portion of the lower cylindrical portion 5211. That is, the lower lid 5212 spreads in the radial direction at the axial lower end of the lower cylindrical portion 5211.

As shown in FIG. 4, an axial upper end outer diameter D421 of the upper cylindrical portion 4211 is smaller than the axial lower end outer diameter D422 of the upper cylindrical portion 4211. Furthermore, an axial lower end outer diameter D521 of the lower cylindrical portion 5211 is smaller than the axial upper end outer diameter D522 of the lower cylindrical portion 5211. Furthermore, the axial lower end outer diameter D521 of the lower cylindrical portion 5211 is smaller than the axial lower end outer diameter D422 of the upper cylindrical portion 4211.

According to the configuration of the example embodiment described above, an air flow space near the axial upper end of the upper cylindrical portion 4211 of the upper impeller 42 is wider than an air flow space near the axial lower end of the upper cylindrical portion 4211. Hence, air can be efficiently transmitted to the exhaust side while suppressing or reducing increase in air flow disturbance on the radially outer side of the upper cylindrical portion 4211. Further, the air flow space near the axial lower end of the lower cylindrical portion 5211 of the lower impeller 52 is wider than the air flow space near the axial upper end of the lower cylindrical portion 5211. Hence, the air can be efficiently transmitted to the exhaust side while suppressing or reducing increase in the pressure of air on the radially outer side of the lower cylindrical portion 5211. As a result, installation space for the upper circuit board 44 and the lower circuit board 54 can be secured in the radial direction, and the pressure-air volume characteristic of air can be favorably maintained.

The axial upper end outer diameter D522 of the lower cylindrical portion 5211 is the same as the axial lower end outer diameter D422 of the upper cylindrical portion 4211. According to this configuration, air on the upper impeller 42 side where pressure rise is suppressed can be smoothly passed to the lower impeller 52 side. Hence, air can be blown efficiently.

The upper cylindrical portion 4211 has a first upper inclined portion 4211*a*. The first upper inclined portion 4211*a* is disposed on an outer peripheral portion of the upper cylindrical portion 4211. The first upper inclined portion 4211*a* has a conical shape with an outer diameter increasing toward the lower side in the axial direction. According to this configuration, the outer shape of the upper cylindrical portion 4211 is inclined along the axial direction and is conical. That is, the air flow space on the radially outer side of the upper cylindrical portion 4211 gradually narrows from the upper side in the axial direction toward the lower side in the axial direction. Hence, it is possible to increase the installation space of the upper circuit board 44 on the lower side in the axial direction of the upper cylindrical portion 4211, while suppressing a rapid pressure rise of air on the radially outer side of the upper cylindrical portion 4211.

The lower cylindrical portion 5211 has a first lower inclined portion 5211*a*. The first lower inclined portion 5211*a* is disposed on an outer peripheral portion of the lower cylindrical portion 5211. The first lower inclined portion 5211*a* has a conical shape with an outer diameter increasing toward the upper side in the axial direction. According to this configuration, the outer shape of the lower cylindrical portion 5211 is inclined along the axial direction and is conical. That is, the air flow space on the radially outer side of the lower cylindrical portion 5211 gradually widens from the upper side in the axial direction toward the lower side in the axial direction. Hence, it is possible to increase the installation space of the lower circuit board 54 on the upper side in the axial direction of the lower cylindrical portion 5211, while gradually reducing the pressure of air on the radially outer side of the lower cylindrical portion 5211.

The upper lid 4212 has a second upper inclined portion 4212*a*. The second upper inclined portion 4212*a* is disposed on an outer peripheral portion of the upper lid 4212. The second upper inclined portion 4212*a* has a conical shape extending axially downward toward the radially outer side. According to this configuration, in order to guide air on the upper side in the axial direction of the upper impeller cup 421 to the radially outer side of the upper cylindrical portion 4211, the air flow space gradually narrows from the upper side in the axial direction toward the lower side in the axial direction. Hence, air can be fed toward the lower side in the axial direction of the upper impeller cup 421 while suppressing the resistance of the air sucked from the air inlet 31.

The lower lid 5212 has a second lower inclined portion 5212*a*. The second lower inclined portion 5212*a* is disposed on an outer peripheral portion of the lower lid 5212. The second lower inclined portion 5212*a* has a conical shape extending axially upward toward the radially outer side. According to this configuration, in order to guide air on the radially outer side of the lower cylindrical portion 5211 to the lower side in the axial direction of the lower impeller cup 521, the air flow space gradually widens from the upper side in the axial direction toward the lower side in the axial direction. Hence, air can be discharged to the outside from the air outlet 32 while suppressing disturbance of air flowing toward the lower side in the axial direction of the lower impeller cup 521.

Axially upper and lower portions of each of the plurality of upper blades 422 are curved in different directions as they extend axially upward and downward, respectively. Specifically, the radially outer end of the axially upper portion of each of the plurality of upper blades 422 curves axially upward toward the upper side in the axial direction. The radially outer end of the axially lower portion of each of the plurality of upper blades 422 curves axially downward toward the lower side in the axial direction. According to these configurations, the flow velocity on the inner side in the radial direction can be suppressed, and the air resistance on the downstream side of the air flow passage 3 can be reduced. Hence, it is possible to improve the pressure-air volume characteristic of air.

Axially upper and lower portions of each of the plurality of lower blades 522 are curved in different directions as the axially upper and lower portions extend axially upward and downward, respectively. Specifically, the radially outer end of the axially upper portion of each of the plurality of lower blades 522 curves axially upward toward the upper side in the axial direction. The radially outer end of the axially lower portion of each of the plurality of lower blades 522 curves axially downward toward the lower side in the axial direction. According to these configurations, the flow velocity on the inner side in the radial direction can be suppressed, and the air resistance on the downstream side of the air flow passage 3 can be reduced. Hence, it is possible to improve the pressure-air volume characteristic of air.

The upper impeller 42 is disposed axially below the air inlet 31. That is, the upper impeller 42 does not protrude to the outside of the air flow passage 3. The lower impeller 52 is disposed axially above the air outlet 32. That is, the lower impeller 52 does not protrude to the outside of the air flow passage 3. That is, the upper impeller 42 and the lower impeller 52 are accommodated in the air flow passage 3. According to this configuration, it is possible to improve the pressure-air volume characteristic of air. Furthermore, since the upper impeller 42 and the lower impeller 52 do not protrude to the outside of the housing 2, it is possible to attach the axial fan 1 easily to a device or the like. The upper impeller 42 and the lower impeller 52 can thus be protected.

As shown in FIG. 4, the outer diameter D44 of the upper circuit board 44 is smaller than the axial lower end outer diameter D422 of the upper cylindrical portion 4211 of the upper impeller 42. That is, the outer diameter of the upper circuit board 44 is smaller than the outer diameter of the upper impeller 42. According to this configuration, it is possible to suppress disturbance of air in the air flow passage 3 caused by the upper circuit board 44 projecting farther to the radially outer side than the upper impeller 42.

As shown in FIG. 4, an outer diameter D54 of the lower circuit board 54 is smaller than the axial upper end outer diameter D522 of the lower cylindrical portion 5211 of the lower impeller 52. That is, the outer diameter of the lower circuit board 54 is smaller than the outer diameter of the lower impeller 52. According to this configuration, it is possible to suppress disturbance of air in the air flow passage 3 caused by the lower circuit board 54 projecting farther to the radially outer side than the lower impeller 52.

3. Other

While example embodiments of the present disclosure have been described above, it will be understood that the scope of the present disclosure is not limited to the above-described example embodiments, and that various modifications may be made to the above-described preferred example embodiments without departing from the gist of the present disclosure. In addition, features of the above-described example embodiments and the modifications thereof may be combined appropriately as desired.

The present disclosure is applicable to an axial fan, for example.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An axial fan comprising:

a housing that extends along a central axis extending vertically, and includes an air inlet at an upper end and an air outlet at a lower end;

an upper impeller that is disposed in an axially upper portion of the housing and rotates about the central axis;

an upper motor that causes the upper impeller to rotate about the central axis;

an upper circuit board that is disposed axially below the upper impeller;

a lower impeller that is disposed in an axially lower portion of the housing and rotates about the central axis;

a lower motor that causes the lower impeller to rotate about the central axis; and a lower circuit board that is disposed axially above the lower impeller;

the upper impeller including:

an upper impeller cup fixed to the upper motor; and a plurality of upper blades arranged in a circumferential direction on an outer surface of the upper impeller cup;

the upper impeller cup including:

an upper conical portion opposing the upper motor in a radial direction and extending along the central axis; and an upper lid extending radially at an axial upper end of the upper conical portion;

the lower impeller including:

a lower impeller cup fixed to the lower motor, and a plurality of lower blades arranged in the circumferential direction on an outer surface of the lower impeller cup; and the lower impeller cup includes:

a lower conical portion opposing the lower motor in the radial direction and extending along the central axis; and a lower lid extending radially at an axial lower end of the lower conical portion; wherein an axial upper end outer diameter of the upper conical portion is smaller than an axial lower end outer diameter of the upper conical portion;

an axial lower end outer diameter of the lower conical portion is smaller than an axial upper end outer diameter of the lower conical portion;

the axial lower end outer diameter of the lower conical portion is smaller than an axial lower end outer diameter of the upper conical portion; and an outer diameter of the lower conical portion continuously increases from an axially lowermost end of the lower conical portion to an axially uppermost end of the lower conical portion, the axially uppermost end of the lower conical portion being adjacent to an axially uppermost end of the lower impeller cup in an axial direction.

2. The axial fan according to claim 1, wherein the upper conical portion includes a first upper inclined portion with an outer diameter increasing toward a lower side in the axial direction.

3. The axial fan according to claim 1, wherein an axial upper end outer diameter of the lower conical portion is equal to an axial lower end outer diameter of the upper conical portion.

4. The axial fan according to claim 1, wherein the upper lid includes a second upper inclined portion that has a conical shape extending axially downward toward a radially outer side.

5. The axial fan according to claim 1, wherein the lower lid includes a second lower inclined portion that has a conical shape extending axially upward toward a radially outer side.

6. The axial fan according to claim 1, wherein a radially outer end of an axially upper portion of each of the plurality of upper blades curves axially upward toward an upper side in the axial direction.

7. The axial fan according to claim 1, wherein a radially outer end of an axially lower portion of each of the plurality of upper blades curves axially downward toward a lower side in the axial direction.

8. The axial fan according to claim 1, wherein a radially outer end of an axially upper portion of each of the plurality of lower blades curves axially upward toward an upper side in the axial direction.

9. The axial fan according to claim 1, wherein a radially outer end of an axially lower portion of each of the plurality of lower blades curves axially downward toward a lower side in the axial direction.

10. The axial fan according to claim 1, wherein the upper impeller and the lower impeller are accommodated in an air flow passage.

11. The axial fan according to claim 1, wherein an outer diameter of the upper circuit board is smaller than an outer diameter of the upper impeller.

12. The axial fan according to claim 1, wherein an outer diameter of the lower circuit board is smaller than an outer diameter of the lower impeller.

* * * * *